US007247821B2

(12) United States Patent
Wilsdorf

(10) Patent No.: US 7,247,821 B2
(45) Date of Patent: Jul. 24, 2007

(54) COOKING DEVICE WITH LUMINOUS DISPLAY

(75) Inventor: Gerd Wilsdorf, Olching (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/771,923

(22) Filed: Feb. 4, 2004

(65) Prior Publication Data

US 2005/0016991 A1 Jan. 27, 2005

Related U.S. Application Data

(63) Continuation of application No. PCT/EP02/08841, filed on Aug. 7, 2002.

(30) Foreign Application Priority Data

Aug. 8, 2001 (DE) ..... 101 38 888

(51) Int. Cl.
*H05B 1/02* (2006.01)

(52) U.S. Cl. ..... 219/506; 219/720; 219/445.1; 374/124; 340/815.53

(58) Field of Classification Search ..... 219/720, 219/492, 497, 501, 506, 445.1, 508; 374/170, 374/105, 106, 124; 340/870.17, 815.53, 340/540

See application file for complete search history.

(56) References Cited

U.S. PATENT DOCUMENTS

| | | | | |
|---|---|---|---|---|
| 3,946,364 | A * | 3/1976 | Codomo et al. | 701/3 |
| 4,568,927 | A * | 2/1986 | Fowler | 345/184 |
| 5,438,180 | A * | 8/1995 | Eisenbrandt et al. | 219/492 |
| 6,497,276 | B2 * | 12/2002 | Clark et al. | 165/206 |
| 2003/0007544 | A1 * | 1/2003 | Chang et al. | 374/100 |

FOREIGN PATENT DOCUMENTS

| | | |
|---|---|---|
| DE | 1 964 483 | 12/1969 |
| DE | 297 12 772 U1 | 9/1997 |
| EP | 0 156 717 A1 | 10/1985 |
| EP | 0 328 025 A2 | 8/1989 |
| FR | 2 489 485 A1 | 3/1982 |
| GB | 2 323 436 A | 9/1998 |

* cited by examiner

*Primary Examiner*—Mark Paschall
(74) *Attorney, Agent, or Firm*—Russell W. Warnock; Craig J. Loest

(57) ABSTRACT

A cooking device containing a housing with a cooking chamber and a door to close off the cooking chamber and at least one control and display panel with an optical luminous display. The control and display panel can display the different operation modes of the cooking chamber and the on and/or off modes of the cooking chamber.

15 Claims, 2 Drawing Sheets

COOKING DEVICE WITH LUMINOUS DISPLAY

BACKGROUND OF THE INVENTION

1. Field of the Invention

The present invention relates to a cooking device comprising a housing, a cooking chamber arranged in the housing, and which can be closed by means of a door, in addition to at least one control and display panel which is provided with an optical luminous display.

2. Discussion of Related Art

To operate electrical domestic appliances it is known to equip them with a luminous display, so that it is also apparent from a distance whether the domestic appliance is switched on or off. DE 1 964 483 discloses for example an oven, in which the luminous display is designed as a light band backlit by a light source. But since the cooking chamber in ovens can also be illuminated without simultaneous heating of the cooking chamber, and thus the associated luminous display signals the on operating mode of the oven only, the luminous display is no indication for the user as to whether the cooking chamber, and thus also the front side of the door closing off the cooking chamber, is hot or cold, so that despite the luminous display there is the danger that the user of the oven will be burnt by the door.

BRIEF SUMMARY OF THE INVENTION

On this basis the object of the present invention is to configure the luminous display of a cooking device of the type initially outlined, such that display of the cooking device is improved.

This task is solved according to the present invention by different operating modes of the cooking chamber being displayed via the optical luminous display of the control and display panels, in addition to switching on and/or off.

The inventive configuring of the luminous display of the control and display panel enables the user of the cooking device to not only indicate that the appliance is switched on or off, but additionally to indicate the operating mode at first glance and also indicate from a greater distance, that is, to show for example whether the cooking chamber is in the heating-up phase, the cooling phase or in the self-cleaning phase; the user can thus be informed by the luminous display of the temperature of the cooking chamber.

According to a first practical embodiment of the invention the luminous display is designed as a substantially linear luminous band, whereof the length advantageously corresponds to the width of the viewing window in the door closing off the cooking chamber, resulting in a simple and clear optical relationship between the luminous display and the cooking chamber, whereof the operating mode is to be displayed.

In a second practical embodiment of the invention the luminous display is designed as a pulsating arrow, so that the size of the illuminating arrow simply indicates the current temperature in the cooking chamber.

To be able to determine from a distance via the luminous display whether there is a high or a low temperature in the cooking chamber, it is put forward according to a first embodiment that the light intensity of the luminous display is in relation to the temperature of the cooking chamber, that is, the light intensity of the luminous display likewise increases for example with increasing temperature.

In a second embodiment of the invention the colour of the luminous display and/or the colour intensity of the luminous display are in relation to the temperature of the cooking chamber.

Another possibility, or one which can be exploited in addition, of displaying the temperature of the cooking chamber via the luminous display, comprises the illuminated length of the substantially linear luminous display being in relation to the temperature of the cooking chamber, which means that a longer section of the luminous display is activated, the higher the temperature of the cooking chamber.

Because very high temperatures are reached in the cooking chamber and thus also on the cooking chamber door during self-cleaning of the cooking chamber, for example by way of pyrolysis or with other known self-cleaning procedures, it is proposed according to the present invention that the luminous display blinks during self-cleaning to accordingly act as a warning function.

In addition to the temperature information via the luminous display it is proposed according to the present invention that each precise temperature can be displayed on a digital display.

Furthermore, with the inventive luminous display it is possible to display the operating mode of the heating-up phase. For this the luminous display is configured such that the newly reached temperature of the cooking chamber is displayed as a steady light, while the range up to the pre-selected end temperature is shown as a blinking light.

Finally, according to the present invention it is suggested that the luminous display is in addition provided with a temperature scale to enable the temperature visualised by the luminous display to be detected precisely.

BRIEF DESCRIPTION OF THE SEVERAL VIEWS OF THE DRAWING(S)

Further features and advantages of the invention will emerge from the following description of the associated drawing, in which an embodiment of an inventive cooking device is illustrated schematically only by way of example, wherein.

DETAILED DISCUSSION OF THE INVENTION

Figure 1:
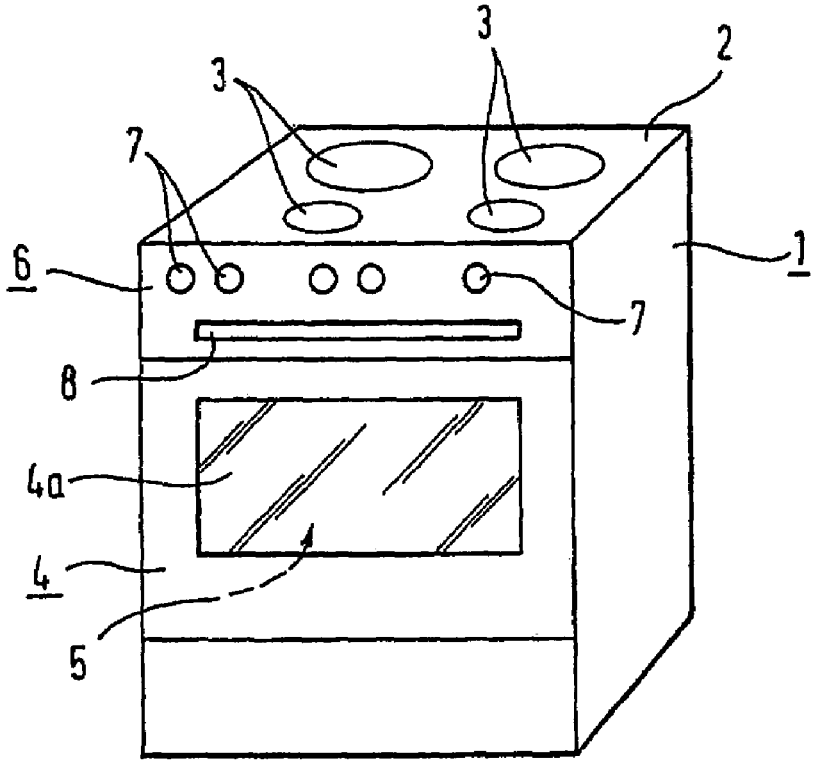
FIG. 1 is a schematic perspective view of an inventive cooking device.

In a perspective view FIG. 1 shows a cooking device, the housing 1 of which is closed on the upper side by a cooktop plate 2, in which four heating elements 3 are integrated. The cooking device also has a cooking chamber 5 arranged in the housing 1, and is closable by a door 4 provided with a viewing window 4*a*. A control and display panel 6 with individual control elements 7, assigned to the heating elements 3 and the cooking chamber 5, serve to activate the separate heating elements 3 of the cooktop plate 2 and of the cooking chamber 5.

Apart from the control elements 7 for switching on and off as well as for temperature regulation of the heating elements 3 and the cooking chamber 5 the control and display panel 6 is equipped with an optical luminous display 8. The function of this luminous display 8 designed according to a first embodiment as a linear luminous band is to display each operating mode of the cooking chamber 5. As specified hereinbelow in FIG. 2, the luminous display 8 enables display not only of whether the cooking chamber 5 is switched on or off, but also it is possible to display, by means of the luminous display 8, the current operating mode, such as for example a heating-up phase or a self-cleaning phase. Also residual heat present in the cooking chamber can be displayed, or the conclusion of a cooking procedure by corresponding exchange of the transparent screen. In addition and alternatively it can be that a cooktop (shown) of the cooking device is provided, and the luminous display 8 displays operating modes of the cooktop, such as for example a specific temperature or a defined cooking mode, which has been reached.

The length of the luminous display 8 corresponds in the illustrated embodiment approximately to the width of the viewing window 4*a* of the door 4 closing the cooking chamber 5, by means of which a clear relation of the luminous display 8 to the function of the cooking chamber 5 is created.

Figure 2:
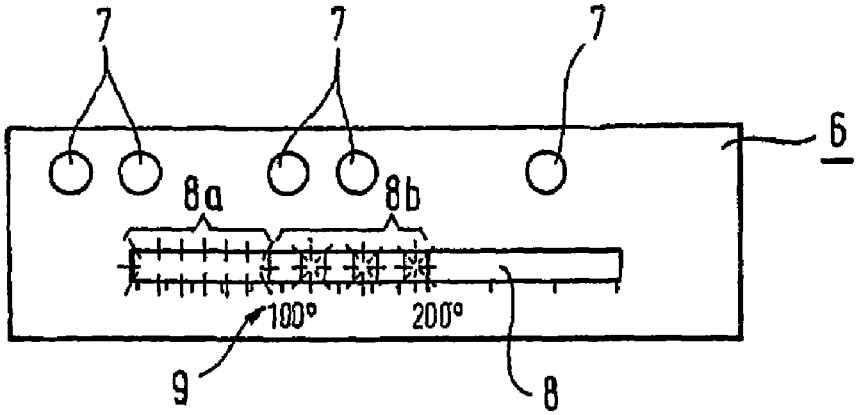
FIG. 2 is an enlarged illustration of the control and display panel in the heating-up phase according to a first inventive embodiment.

In the display situation of the luminous display 8 shown in FIG. 2 a first section 8*a* of the luminous display 8 illuminates with steady light, whereas the light of a second section 8*b* blinks. This display situation indicates that the cooking chamber 5 is in the heating-up phase, whereby the steady light of the first section 8*a* displays the range of the temperature already reached and the blinking second section 8*b* shows the temperature range yet to be heated.

As is further evident from FIG. 2, in the illustrated embodiment the luminous display 8 is in addition equipped with a temperature scale 9, from which the user of the cooking devices can infer the exact temperature visualised by the luminous band. Pressing the control screen 6 assigned to the luminous display 8 creates the scale 9.

Apart from the above described option of displaying the temperature and/or the operating mode of the cooking chamber 5 by means of the luminous display 8, it is possible to display the temperature of the cooking chamber 5 by way of a changing colour or colour or light intensity, so that for example the colour intensity or the illumination power increases, the higher the temperature of the cooking chamber 5, so that the user can already see from a distance whether the door 4 of the cooking chamber 5 might be hot. Likewise, blinking of the luminous display 8 for example can indicate that just the self-cleaning phase of the cooking chamber 5 is running, wherein, in particular in the case of pyrolysis, the temperature in the cooking chamber 5 is particularly high, so that the blinking light has a warning function.

Figure 3:
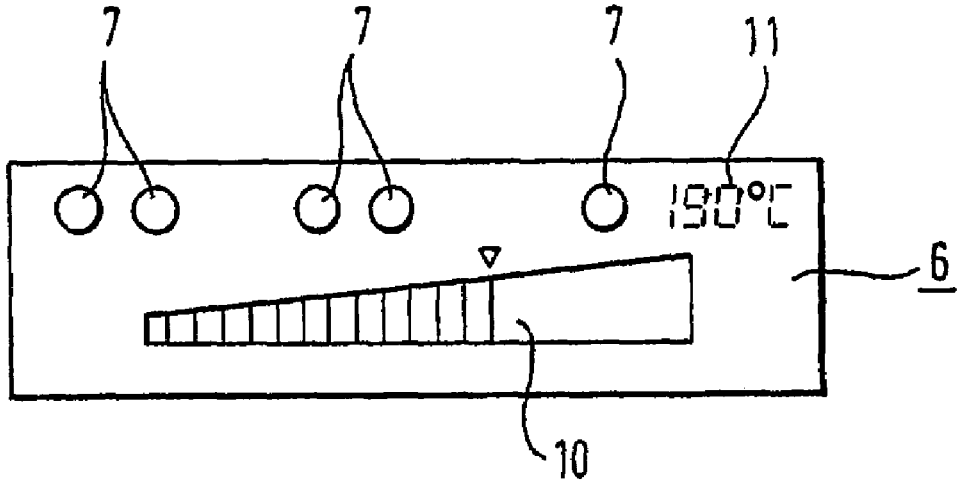
FIG. 3 is a view corresponding to FIG. 2 and illustrating a second embodiment of the control and display panel.

In the second embodiment illustrated in FIG. 3 the luminous display 8 is configured as a pulsating arrow 10. As is evident from the drawing, the illuminated length and height of the pulsating arrow 10 increase as the temperature rises, so that a clear optical impression of the temperature ratios in the cooking chamber 5 can be determined by means of these displays. For displaying the exact cooking chamber temperature the illustrated luminous display 8 is additionally provided with a digital temperature display 11.

Figure 4:
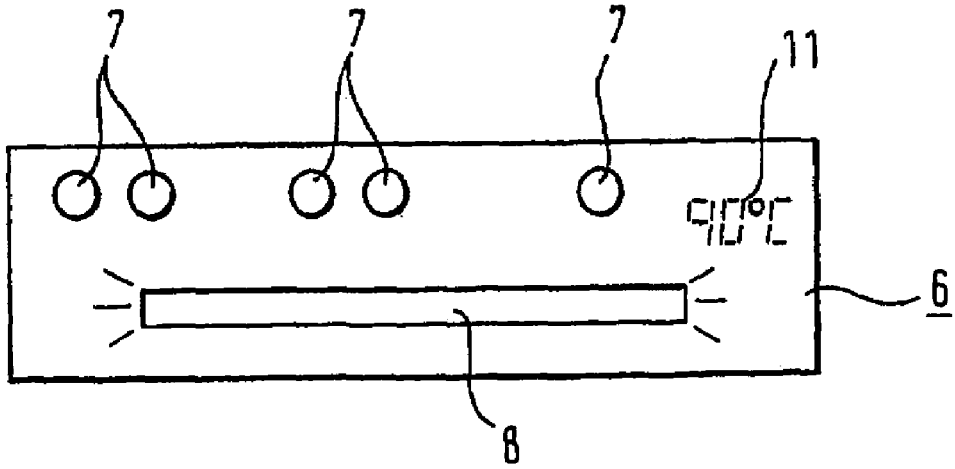
FIG. 4 is a view corresponding to FIG. 2 and illustrating a third embodiment of the control and display panel.

As is finally evident from FIG. 4 the digital temperature display 11 can also be combined with the linear luminous band, as was described hereinabove for FIG. 2, so that in addition to the rudimentary information given by the luminous display 8 the user of the cooking devices is also informed of the exact temperature in the cooking chamber 5.

The invention claimed is:

1. A cooking device, comprising:

a housing;

a cooking chamber arranged in said housing, the cooking device having multiple operating modes indicating a stage of a cooking cycle and including at least a heating-up phase and a cooling phase, the heating-up and cooling phases dependent on activation and deactivation of at least one heating element;

a door on said housing for closing said cooking chamber; and at least one control and display panel with an optical luminous display which can display the different operating modes of said cooking chamber and the on and/or off modes of said cooking chamber, wherein said luminous display includes a substantially linear luminous band and has at least one of:

a light or color intensity which is in direct relation to the temperature of said cooking chamber; and a color which is in direct relation to the temperature of said cooking chamber.

2. The cooking device according to claim 1, including said luminous display is a pulsating arrow of increasing/decreasing vertical bars.

3. The cooking device according to claim 1, including said illuminated length of said substantially linear luminous band is variable in relation to the temperature of said cooking chamber.

4. The cooking device according to claim 1, including said luminous display blinks or displays a running light during a self-cleaning operation of said cooking chamber, such as pyrolsis.

5. The cooking device according to claim 1, including said illuminated length of said substantially linear luminous band in a heating up phase of said cooking chamber has a first band portion which displays the temperature already reached as a steady light and a second band portion which displays the temperature yet to be reached as a blinking light.

6. The cooking device according to claim 1, including said door including a viewing window having a width and said luminous display having a length substantially equal to said window width.

7. The cooking device according to claim 1, including said luminous display further including a temperature scale.

8. The cooking device according to claim 1, including said luminous display further including a digital temperature display.

9. A cooking device, comprising:

a housing;

a cooking chamber arranged in said housing, the cooking device having multiple operating modes indicating a stage of a cooking cycle and including at least a heating-up phase and a cooling phase, the heating-up and cooling phases dependent on activation and deactivation of at least one heating element;

a door on said housing for closing said cooking chamber;

at least one control and display panel having control elements for controlling operation of the cooking device and the cooking chamber, with said display panel being separate and distinct from said control elements; and said display panel comprising an optical luminous display configured for displaying each operating mode of the cooking chamber, including at least current operating mode, residual heat present in the chamber after the cooking chamber is no longer being heated, and the on and/or off modes of said cooking chamber, wherein said luminous display includes a substantially linear luminous band and has at least one of:

a light or color intensity which is in direct relation to the temperature of said cooking chamber; and a color which is in direct relation to the temperature of said cooking chamber.

10. A method of displaying operating conditions of a cooking device having a housing, a cooking chamber arranged in said housing, the cooking device having multiple operating modes indicating a stage of a cooking cycle and including at least a heating-up phase and a cooling phase, the heating-up and cooling phases dependent on activation and deactivation of at least one heating element, a door on said housing for closing said cooking chamber; and at least one control and display panel with an optical luminous display including a substantially linear luminous band having at least one of a light or color intensity which is in direct relation to the temperature of said cooking chamber and a color which is in direct relation to the temperature of said cooking chamber, the method comprising the acts of:

indicating the on and/or off modes of said cooking chamber with the display;

indicating the current operating mode of said cooking chamber with the display;

indicating a current temperature within the cooking chamber in the heating-up phase as a first band portion on the linear luminous band width a steady light and indicating a desired yet to be reached temperature within the cooking chamber as a second band portion with a blinking light, the illuminated length of said substantially linear luminous band being variable in relation to the temperature of said cooking chamber.

11. The method according to claim 10, wherein said luminous display blinks or displays a running light during a self-cleaning operation of said cooking chamber, such as pyrolsis.

12. The method according to claim 10, wherein said door includes a viewing window having a width and said luminous display having a length substantially equal to said window width.

13. The method according to claim 10, wherein said luminous display further including a temperature scale.

14. A cooking device, comprising:

a housing;

a cooking chamber arranged in said housing, the cooking device having multiple operating modes indicating a stage of a cooking cycle and including at least a heating-up phase and a cooling phase;

a door on said housing for closing said cooking chamber; and at least one control and display panel with an optical luminous display which can display the different operating modes of said cooking chamber and the on and/or off modes of said cooking chamber, wherein said luminous display includes a substantially linear luminous band;

wherein said door includes a viewing window having a width and said luminous display having a length substantially equal to said window width.

15. A method of displaying operating conditions of a cooking device having a housing, a cooking chamber arranged in said housing, the cooking device having multiple operating modes indicating a stage of a cooking cycle and including at least a heating-up phase and a cooling phase, a door on said housing for closing said cooking chamber; and at least one control and display panel with an optical luminous display including a substantially linear luminous band, the method comprising the acts of:

indicating the on and/or off modes of said cooking chamber with the display;

indicating the current operating mode of said cooking chamber with the display;

indicating a current temperature within the cooking chamber in the heating-up phase as a first band portion on the linear luminous band width a steady light and indicating a desired yet to be reached temperature within the cooking chamber as a second band portion with a blinking light, the illuminated length of said substantially linear luminous band being variable in relation to the temperature of said cooking chamber;

wherein said door includes a viewing window having a width and said luminous display having a length substantially equal to said window width.

* * * * *